United States Patent [19]

Gach

[11] 4,334,639

[45] Jun. 15, 1982

[54] CHILD-RESISTANT DISPENSING CLOSURE

[75] Inventor: Peter P. Gach, Evansville, Ind.

[73] Assignee: Sunbeam Plastics Corporation, Evansville, Ind.

[21] Appl. No.: 143,819

[22] Filed: May 8, 1980

Related U.S. Application Data

[63] Continuation-in-part of Ser. No. 108,642, Dec. 31, 1979, abandoned.

[51] Int. Cl.[3] ..... B65D 47/02

[52] U.S. Cl. ..... 222/153; 222/543; 222/556

[58] Field of Search ..... 222/153, 543, 556; 220/339; 215/216, 237

[56] References Cited

U.S. PATENT DOCUMENTS

| | | | |
|---|---|---|---|
| 3,240,405 | 3/1966 | Abbott | 222/543 |
| 3,661,248 | 5/1972 | Isen et al. | 220/339 X |
| 3,752,371 | 8/1973 | Susuki et al. | 222/517 X |
| 3,873,006 | 3/1975 | Fields | 222/153 |
| 4,010,875 | 3/1977 | Babiol | 222/517 |
| 4,209,100 | 6/1980 | Uhlig | 222/153 X |

*Primary Examiner*—Robert J. Spar
*Assistant Examiner*—Frederick R. Handren
*Attorney, Agent, or Firm*—Fisher, Gerhardt, Crampton & Groh

[57] ABSTRACT

A child-resistant dispensing closure fabricated from resilient material which has an inverted cup-shaped body, an axially protruding nozzle and a saucer-shaped lid for closing the nozzle. The lid is connected to the body by a flexible hinge which is unitary with the body and the lid and which is located at one edge of the body. There are cooperating means for retaining the lid in closed position overlying the body and the nozzle, the catch means being located diametrically opposite the hinge. The lid has a maximum diameter no greater than the diameter of the top of the body. The catch means may be at least partially disengaged by moving the lid laterally relative to the body in a direction transverse to the diameter extending between the hinge and the catch means which also protrudes a portion of the lid radially beyond the top of the body. By grasping the protruding portion of the lid, the lid then may be swung angularly away from closing position.

11 Claims, 20 Drawing Figures

FIG. 1
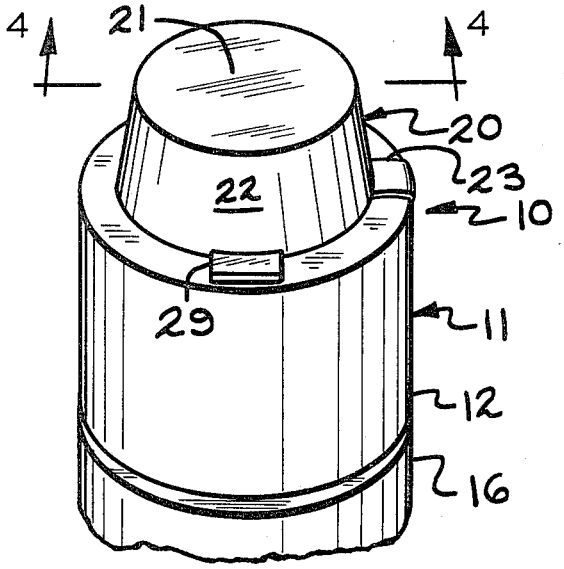
FIG. 2
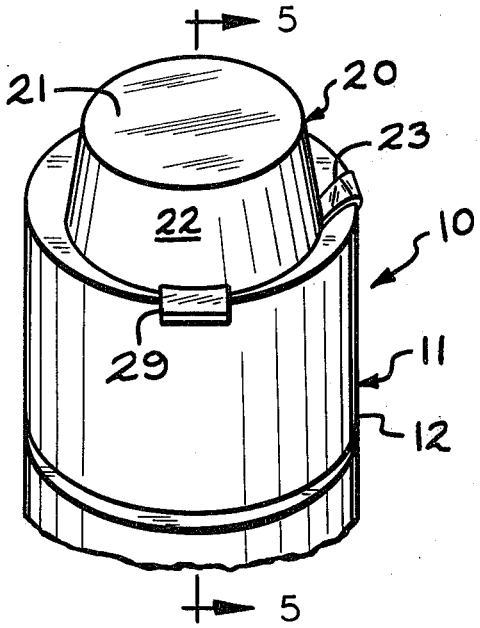
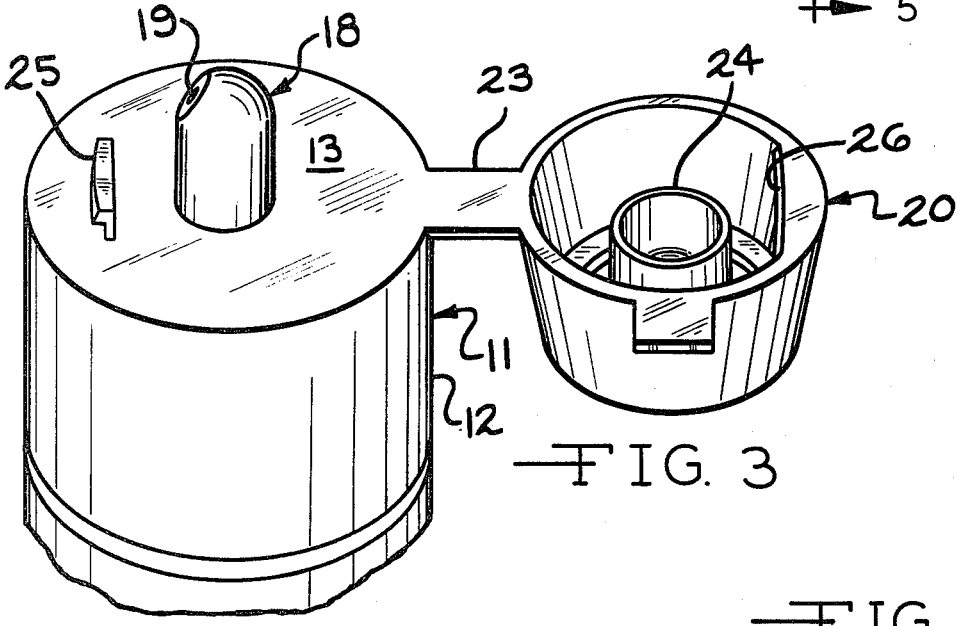
FIG. 3
FIG. 4
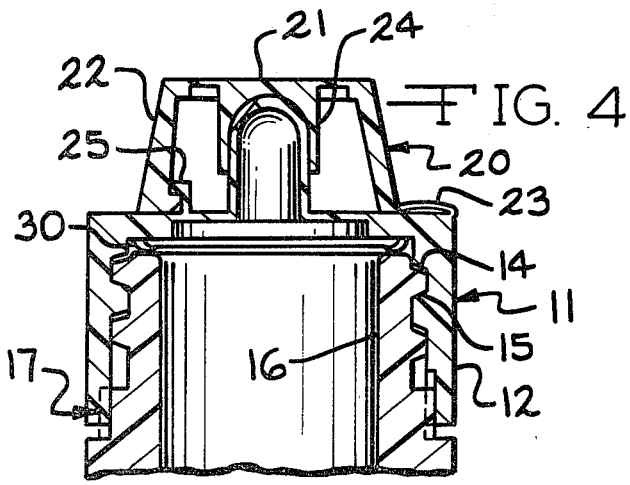
FIG. 5
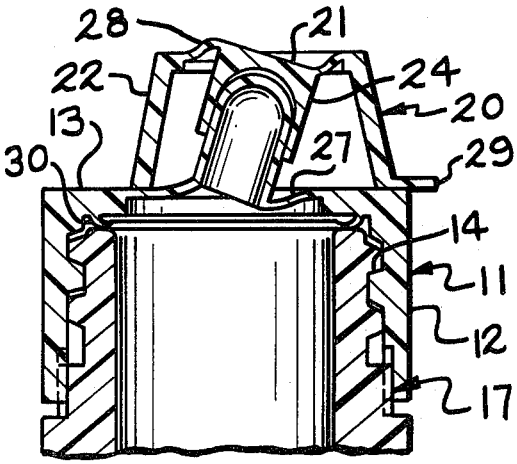

FIG. 17
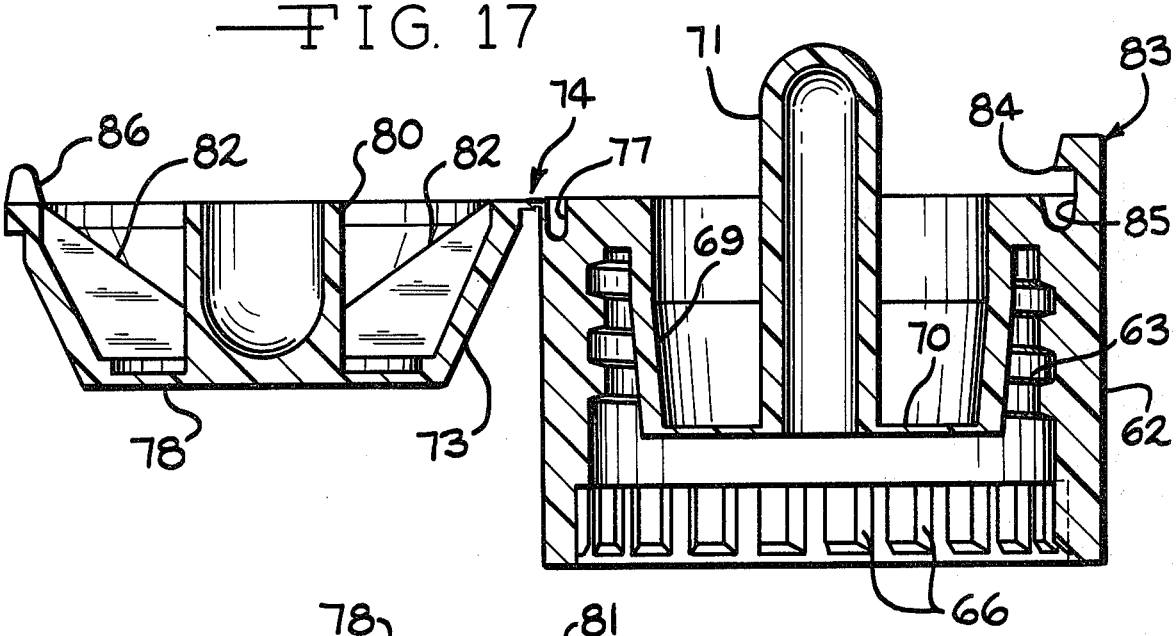
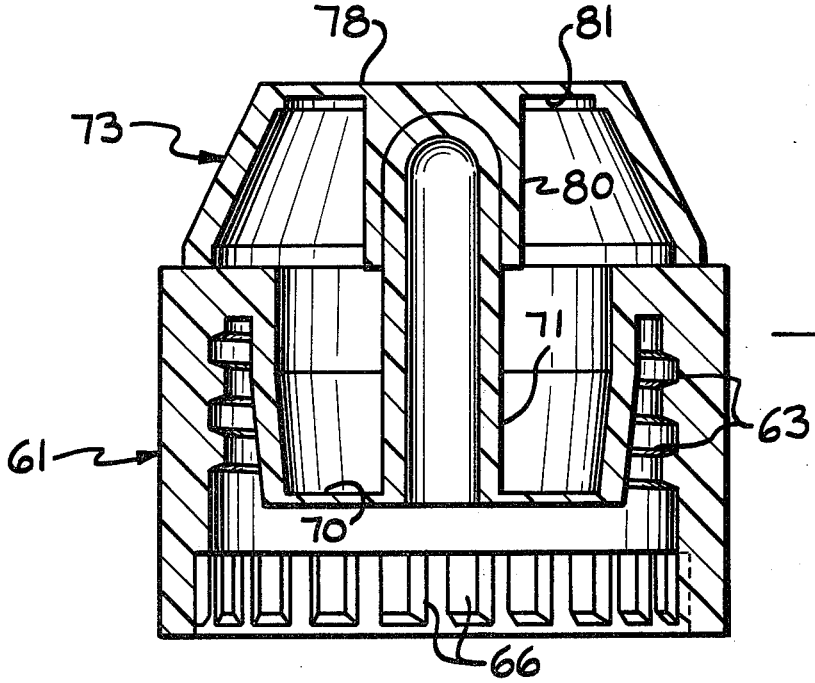
FIG. 18
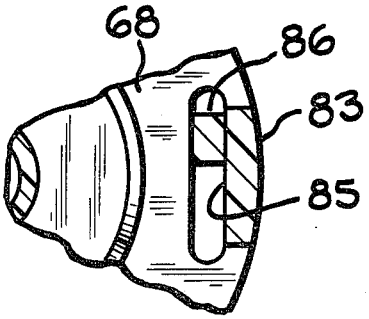
FIG. 19
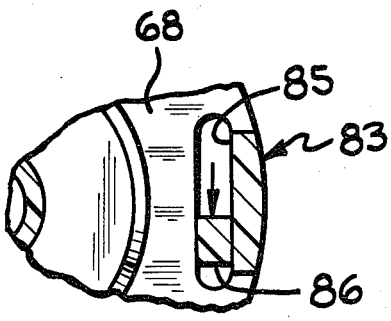
FIG. 20

CHILD-RESISTANT DISPENSING CLOSUREThis application is a continuation-in-part of my application Ser. No. 108,642 filed Dec. 31, 1979, now abandoned.

BACKGROUND OF THE INVENTION

In common with application Ser. No. 108,642, the now abandoned, instant application discloses a modified form of a child-resistant dispensing closure of the same general type as those disclosed and claimed in my earlier application Ser. No. 061,832, filed July 30, 1979, now U.S. Pat. No. 4,236,653, granted Dec. 2, 1980.

In common with the child-resistant dispensing closures of my earlier application, each of the closures of the instant case is fabricated from a resilient plastic material and consists of a cup-shaped body which is adapted to be retained on the end of a container, an axially protruding dispensing nozzle on the top of the body and a saucer-shaped lid for closing the nozzle, the lid being connected to the closure parts by a flexible hinge. In common with the earlier application the closures of the present case also comprise latching means which retain the lid in nozzle closing position on top of the body.

The closures of the present case differ from those of my earlier application Ser. No. 061,832 in that the retaining means of the present case may be disengaged by moving the lid laterally of the closure body in a direction transverse to the median diametric line of the hinge in order to protrude a portion of the lid (some embodiments comprising a horizontally extending tab) radially beyond the top of the body so that the protruding portion can be grasped to swing the lid away from closing position.

A closure according to the instant invention constitutes an improvement over dispensing closures of the art because it is rendered child-resistant by reason of the fact that in closing position, the lid has no protruding parts and, therefore, the lid cannot readily be grasped and swung away from closing position. The lid must first be moved laterally in order to at least partially disengage the catch means before the lid can be swung away from closing position to expose the nozzle in order that content material may be dispensed from the container.

BRIEF DESCRIPTION OF THE DRAWINGS

FIG. 1 is a fragmentary view in perspective of a closure embodying the invention shown in closed position;

FIG. 2 is a view similar to FIG. 1 but showing the lid for the closure moved laterally relative to the closure body in the first step which is necessary to move the closure lid from closed to open position;

FIG. 3 is a view in perspective similar to FIGS. 1 and 2 but shown on a slightly enlarged scale with the closure lid in open position;

FIG. 4 is a fragmentary vertical sectional view along a transverse diameter as generally indicated by the reference line 4—4 of FIG. 1 and showing the closure in closed position;

FIG. 5 is a view similar to FIG. 4 but taken along line 5—5 of FIG. 2;

FIG. 17 is a vertical sectional view taken along the line 17—17 of FIG. 13 and shown on an enlarged scale;

FIG. 18 is a vertical sectional view taken along the line 18—18 of FIG. 11;

FIG. 19 is a fragmentary, horizontal, sectional view taken along the line 19—19 of FIG. 15 and shown on an enlarged scaled; and FIG. 20 is a view similar to FIG. 19 but showing the illustrated parts in the position to which they are moved when the lid of the closure is moved from the position shown in FIGS. 11 and 15 to the position shown in FIGS. 12 and 16.

DESCRIPTION OF PREFERRED EMBODIMENTS

FIGS. 1-5

Figures 6, 7, 8, 9, 10:
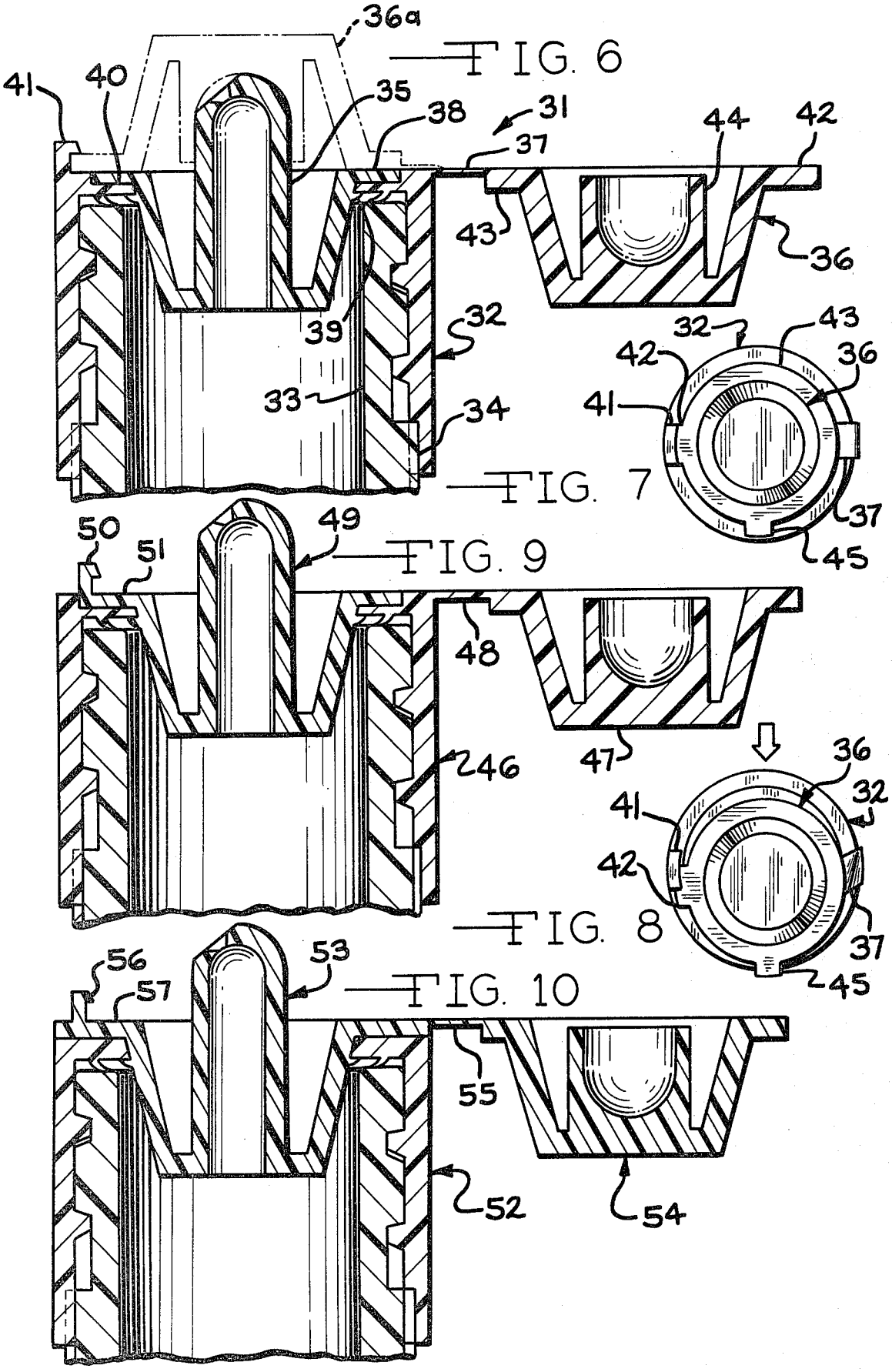
FIG. 6 is a diametric, veritcal sectional view on an enlarged scale of a second embodiment showing the closure lid in open position in solid lines and in phantom in closing position.
FIG. 7 is a plan view on a smaller scale showing the lid in closing position.
FIG. 8 is a view similar to FIG. 7 showing the lid moved laterally in order to open the closure.
FIG. 9 is a view similar to FIG. 6 of a third embodiment of the invention.
FIG. 10 is a view similar to FIGS. 6 and 7 of a fourth embodiment of the invention.

A closure generally indicated by the reference number 10 comprises a body 11 having a circular skirt 12 and a disc-like top 13. Threads 14 on the inner wall of the skirt 12 mate with complementary threads 15 on a container neck 16. Preferably the skirt 12 and container neck 16 also have one-way ratchet means, generally indicated by the reference number 17, so that when the closure 10 is threaded downwardly onto the container neck 16 it cannot be rotated in a retrograde direction, thus adding to its child-resistant quality.

In the embodiment illustrated in FIGS. 1-5 the body 11 also has an integral, axially protruding nozzle 18 and the nozzle 18 has an angularly directed orifice 19.

The closure also comprises a generally saucer-shaped lid 20 which has a flat disc-like top 21 and a frustoconical rim 22. The lid 20 is integrally connected to the closure 10, in this case to the body 11, by a flexible hinge 23. A cup-shaped nozzle cap 24 is formed on the underside of the lid top 21 and is of such size as to closely embrace the nozzle 18 when the lid 20 is in closing position as illustrated in FIG. 4.

Cooperating catch means consisting of an overhanging rib 25 on the body top 13 and an inwardly extending lip 26 at the margin of the lid rim 22 are provided for retaining the lid in closing position as illustrated in FIGS. 1 and 4. The rib 25 and lip 26 are aligned diametrically from the hinge 23.

As can best be seen in FIGS. 4 and 5 the body top 13 and the lid top 21 both have relatively thin annular webs 27 and 28, respectively, which surround the bases of the nozzle 18 and the nozzle cap 24.

Because the entire closure is molded from a resilient resinous material, such as polyethylene, or the like, an older child or an adult may move the lid transversely relative to the diametric line extending between the hinge 23 and the catch means 25–26 against the resiliency of the webs 27 and 28, as shown in FIG. 5. This transverse movement at least partially disengages the lip 26 from the rib 25 and, simultaneously, extends a tab 29 outwardly beyond the upper margin of the closure body 11 so that it may be grasped by the fingers of the person wishing to open the closure to enable that person to swing the lid from the position illustrated in FIGS. 2 and 5 to the position illustrated in FIG. 3.

It will also be observed by reference to FIG. 1, that when the lid 20 is in closing position with the nozzle cap 24 closing the nozzle 18, the tab 29 lies closely adjacent the body top 13 and does not extend outwardly beyond the margin of the body 11 thereby making it difficult if not impossible to grasp the lid 20 until it has first been moved to the position shown in FIGS. 2 and 5.

The closure 10 is sealed to the container neck 16 by a flexible annular web 30 which extends around the underside of the body top 13 and is squeezed against the lip of the container neck as shown in FIGS. 4 and 5.

FIGS. 6–8

In the embodiment of the invention illustrated in FIGS. 6–8, inclusive, a closure 31 comprises a body 32 adapted to be threaded onto a container neck 33 and to be retained thereon by one-way ratchet means 34. In this embodiment, however, a nozzle 35 initially is molded as a separate piece from the integrally connected body 32, a lid 36 and their flexible hinge 37. The nozzle 35 has a pair of spaced annular webs 38–39 which extend radially outwardly and are adapted to snap into a circular opening in the top of the body 32 and above and below an inwardly directed flange 40 of the closure body 32.

A rib 41 is formed at the outer edge of the top of the body 32 opposite the hinge 37 and a radially extending tongue 42 is formed on an annular rim 43 surrounding the lid 36. A nozzle cap 44 is formed on the underside of the top of the lid 36 and is of such size as to closely embrace the upper end of the dispensing nozzle 35 when the lid 36 is swung over into closing position shown in broken lines and indicated by the reference number **36*a* in FIG. 6**.

The lid 36 is held in closing position by the engagement of the tongue 42 underneath the rib 41 as is shown in FIG. 7.

When it is desired to open the closure 31 to permit dispensing of the content material, the user moves the lid 36 laterally from the position shown in FIG. 7 to the position illustrated in FIG. 8, partially disengaging the tongue 42 from beneath the rib 41 and extending a tab 45 radially outwardly from the position overlying the web 38 of the nozzle 35 to a position where it extends beyond the upper edge of the top of the body as illustrated in FIG. 8.

In contrast to the embodiment of FIGS. 1–5, inclusive, in the closure of FIG. 6, the body 32 and lid 36 are integral and the rib 41 is molded on the edge of the body 32. The nozzle 35 is a second piece adapted to snap in place in the open upper end of the body 32.

FIG. 9

In the embodiment shown in FIG. 9, a closure body 46, lid 47 and hinge 48 are integral but, in this case, as in the embodiment of FIG. 6, a nozzle 49 is a separate molded piece and a lid retaining rib 50 is molded at one side of a top web 51 comparable in other respects to the web 38 of the embodiment of FIG. 6.

As in the earlier embodiments of FIGS. 1–5, inclusive, and FIG. 6, the lid 47 of FIG. 9 has a radially extending tab (not shown) which protrudes beyond the upper margin of the top of the body 46 when the lid 47 is moved laterally, similarly to the movement illustrated in FIG. 8.

FIG. 10

In the embodiment of FIG. 10 a closure has a body 52 and, in this case, it is a piece which is separate from an integral piece comprising a nozzle 53, a lid 54 and their flexible integral hinge 55. Also in this embodiment a lid retaining rib 56 is part of the integral nozzle-lid-hinge element 53, 54, 55.

Again, as in the earlier embodiments of the invention, the lid 54 is retained in closing position atop the nozzle 53 and, in order to be opened, mut be shifted laterally, in the manner illustrated in FIG. 8, to extend a tab (not shown) beyond the margin of an upper web 57 of the nozzle 53.

FIGS. 11–20

The embodiment of the invention illustrated in FIGS. 11–20, like the earlier modification, is a closure 60 comprising a body 61 having a skirt 62 which is threaded on its inner surface with threads 63. The closure threads 63 mate with threads 64 on a neck 65 of a container which is fragmentarily shown in a number of the figures.

In common with the earlier embodiments of the invention, the container neck 65 and the lower end of the cap skirt 62 have cooperating ratchet teeth 66 and 67 which prevent the closure 60 from being turned off of the container neck 65 once it has been threaded down tightly into the position illustrated in FIGS. 11, 12, 15 and 16. The ratchet teeth 66 and 67 constitute part of the closure which contribute to making it child-resistant in that removal of the entire closure 60 from the container is virtually impossible once it has been threaded into the closed illustrated position.

The closure body 61 has a top annular rim 68 which extends inwardly and is integral with an inner circular wall 69 spaced inwardly from the inner surface of the skirt 62 only a distance such that when the closure is threaded onto the neck 65 of the container, the end of the threaded neck 65 is tightly squeezed between the skirt 61 and the inner wall 69 providing a leak-proof connection.

An inwardly directed, flexible, annular flange 70 at the bottom of the inner wall 69 integrally is connected to and supports an axially extending dispensing nozzle 71 which has a dispensing orifice 72 at its outer end.

The closure 60 also includes a saucer-shaped lid 73 which, of course, is highly similar to the lids of the earlier embodiments. The lid 73 is integrally connected to the body 61 by a flexible hinge web 74 which is connected at its outer side to an annular rim 75 of the lid 73 and at its inner side to a thin web 76 (see also FIG. 14) formed at the outer side of an arcuate recess 77 in the body rim 68.

The lid 73 has a circular top 78 and a frustoconical wall 79, the rim 75 being located at the bottom edge of the wall 79 and extending slightly radially outwardly therefrom. A nozzle cap 80 is formed on the underside of the lid top 78 and is centrally located so as to telescope over the end of the dispensing nozzle 72 when the lid 73 is swung into closing position as illustrated, particularly, in FIGS. 11, 15 and 18. The lid top 78 has a thin annular section 81 surrounding the base of the nozzle cap 80 and, in this embodiment, the nozzle cap 80 is braced to the lid wall 79 by a pair of radially extending webs 82 (see FIG. 13, particularly).

Figure 11:
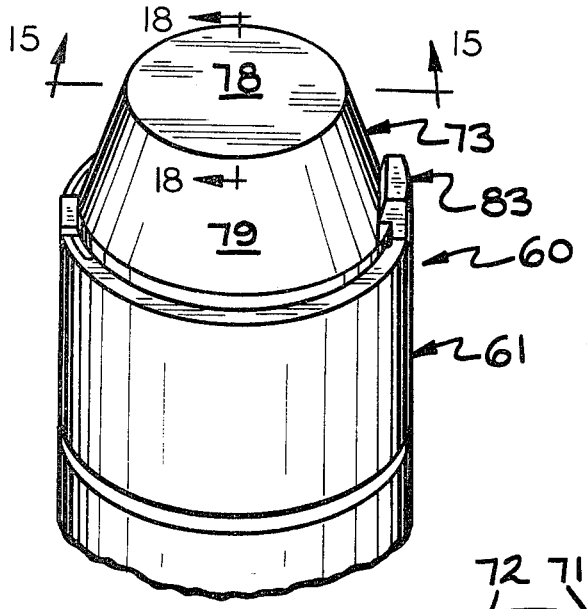
FIG. 11 is a fragmentary view in perspective of yet another embodiment of the invention in closed position, the closure being shown on the upper end of the neck of a container which is fragmentarily indicated.
Figure 12:
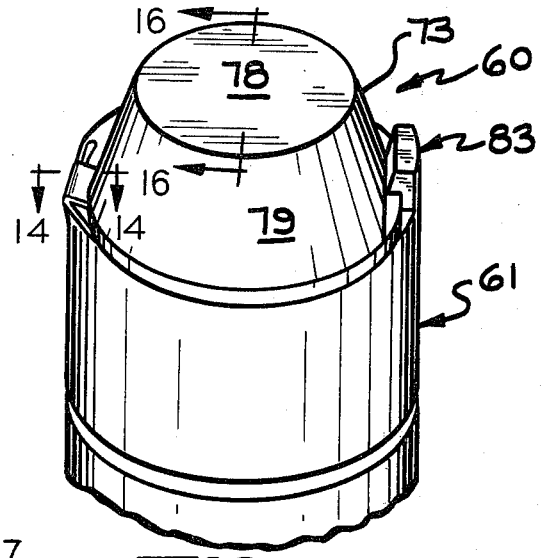
FIG. 12 is a view similar to FIG. 11 but showing the lid for the closure moved to a first position in which an older child or an adult can grasp a portion of the lid to swing it to open position.
Figure 13:
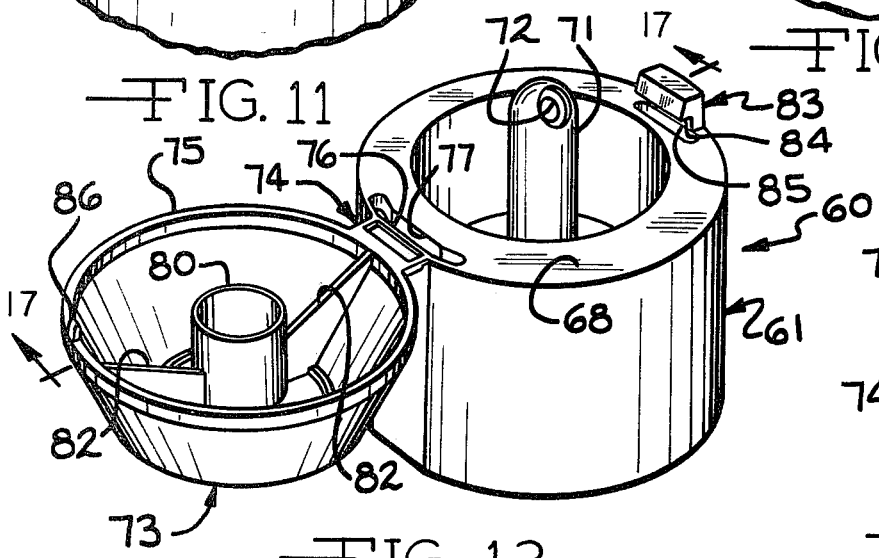
FIG. 13 is a view in perspective of the closure embodying this modification of the invention in fully open position.
Figure 15:
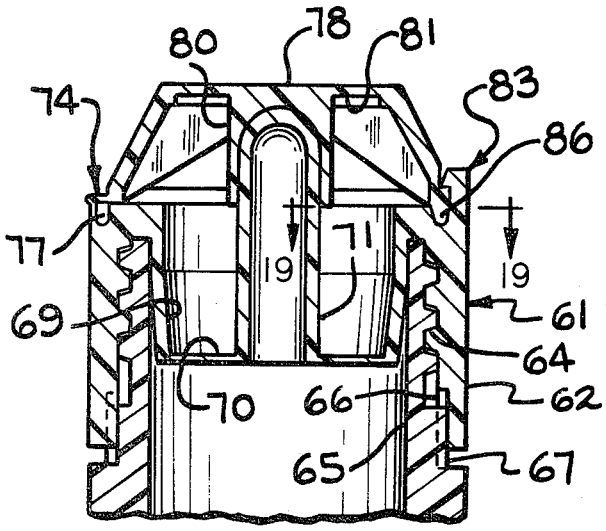
FIG. 15 is a fragmentary, diametric, vertical sectional view taken generally along the line 15—15 of FIG. 11.
Figure 16:
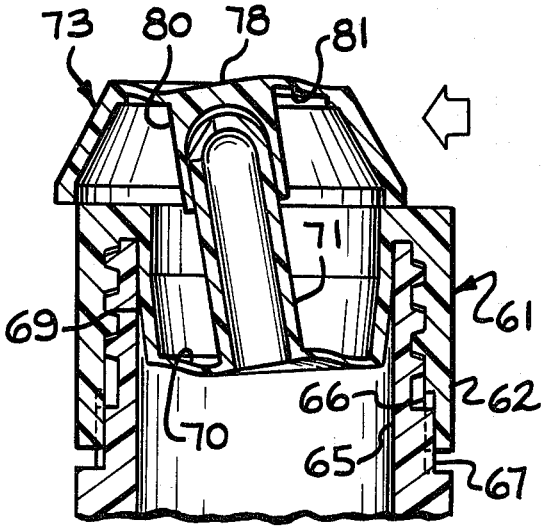
FIG. 16 is a view similar to FIG. 15 but taken generally along the line 16—16 of FIG. 12 and showing the closure in a position rotated 90° relative to the position illustrated in FIG. 15 to illustrate how the lid is first moved laterally relative to the closure body to protrude a portion of the lid beyond the edge of the closure body thus to enable it to be grasped and swung open.

A generally tangentially extending catch 83 is erected on the body rim 68 diametrically opposite to the hinge web 74 and has an inwardly extending lip 84 spaced above the body rim 68 a distance such that the lid rim 75 will fit beneath the lip 84 when the lid 73 is on top of the body 61 either in the closing position illustrated in FIGS. 11 and 15 or in the slightly laterally displaced position illustrated in FIGS. 12 and 16.

The catch lip 84 overlies a slot 85 molded in the body rim 68, the slot 85 being of such size as to receive a lug 86 when the lid 73 is swung into the closing position illustrated in FIG. 11 and also when it is in the laterally displaced position illustrated in FIG. 12. The engagement of the lug 86 in the slot 85 is most clearly illustrated in FIGS. 19 and 20 showing the position of the lug 86 in the slot 85 when the lid 73 is in the closing position (FIG. 19). FIG. 20 specifically shows the movement of the lug 86 as it is limited by the slot 85 when the lid 73 is moved laterally to the position illustrated in FIGS. 12 and 16.

Figure 14:
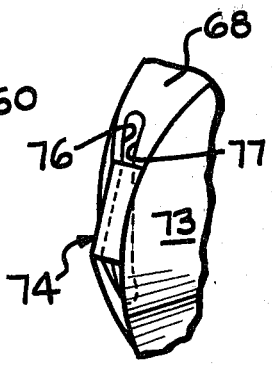
FIG. 14 is a fragmentary view taken from the position indicated by the line 14—14 of FIG. 12 and shown on an enlarged scale.

In common with the earlier described embodiments of the invention, it is the resiliency of the parts such as the flange 70 at the base of the dispensing nozzle 71, the nozzle 71 itself, and the annular portion 81 of the lid top 78 which resist movement of the lid 73 from the closing position to the first position illustrated in FIGS. 12 and 16. It will also be observed that even after the lid 73 has been moved laterally, twisting the hinge 74 and the flexible web 76 (as shown in FIG. 14) the rim 75 of the lid 73 remains engaged with the catch 83 even while the lid 73 is moved to the limit of its lateral movement, this being controlled by the engagement of the lug 86 in the slot 85 as illustrated in FIG. 20.

Also, in common with the earlier modifications of the invention, even after an older child or an adult has moved the lid 73 laterally, the catch means remain engaged so that if the lid is released at this point, the resiliency of the flexible parts will move it back to its central closing position as shown in FIG. 1.

The dispensing closure of the invention therefore remains child-resistant but readily may be opened by an older child or an adult by pushing the lid laterally, flexing the integral hinge and projecting a portion of the lid beyond the margin of the closure body so it can be grasped and swung upwardly and over to fully open position to permit dispensing of the content material.

Having described my invention I claim:

1. A child resistant dispensing closure for a container fabricated of flexible material, said closure comprising: a cup shaped body member adapted for attachment to a container, said body member having a top surface bounded by a circumferential edge, a lid member overlying said body member, a nozzle formed integrally with said body member and forming a dispensing orifice, a cover for closing the orifice in said nozzle being formed on said lid member, a flexible hinged web connecting said lid member to said body member and providing for angular swinging movement of said lid member relative to said body member from a closed position in which said cover is engaged with said nozzle and a lower surface of said lid member engages the top surface of said body member with no portion of said lid member extending beyond said circumferential edge of said body member, said web also providing for lateral translatory movement in a direction transverse to the direction of said angular movement from said closed position relative to said body member to an opening position wherein an edge of said lid member extends beyond the circumferential edge of said body member while said nozzle and cover remain engaged in closed position, said nozzle being connected to said body member by flexible portions to thereby resiliently urge said lid in a return direction from said opening position to said closed position, and cooperating catch means on said body and lid members engaged when said lid member is in a closed position and being partially disengageable upon said lateral movement of said lid member from said closed position to said opening position, whereby said edge of said member affords a grip for disengaging said catch means and swinging said lid member to a fully open position.

2. A child-resistant dispensing closure according to claim 1 in which the lid has a circular disc-like top and a rim having a size such that no part thereof extends beyond the top of the body member in closed position.

3. A child-resistant dispensing closure according to claim 1 and inter-engaging means on said closure member and the container which resist counter rotation of said closure member relative to said container.

4. A child-resistant dispensing closure according to claim 1 in which the nozzle has a dispensing orifice in its upper end and the cover is a cup on the under side of the lid member which telescopes over the upper end of said nozzle when said lid is in closed position.

5. A child-resistant dispensing closure according to claim 1 in which all of the body member, nozzle, lid member and hinge are integral.

6. A child-resistant dispensing closure according to claim 1 in which the lid member is saucer-shaped having a generally circular top and a rim which engages the top of the body member in closed position and in which the margin of said lid rim is cut back providing a peripheral lip on the margin of said lip rim and there is an inwardly directed overhanging lip on the edge of the body beneath which the lip on said lid rim is engaged in closed position.

7. A child-resistant dispensing closure according to claim 6 and co-operating means on the lid member and the body member for limiting the lateral movement of said lid member from closed position to a position in which the edge of said lid member extends beyond the edge of said body with the lips on said lid member and said body member still partially engaged.

8. The child resistant dispensing closure of claim 1 wherein said nozzle projects upwardly from the top of said closure member and wherein said lid member is cup shaped to overlie said body member and nozzle.

9. The child resistant dispensing closure of claim 1 wherein said nozzle is recessed into the top of said body member.

10. A unitary child-resistant closure comprising:

(a) a body having (1) an annular threaded skirt, (2) a generally flat, inwardly extending, annular rim at the upper edge of said skirt, (3) a downwardly extending, inner wall concentric with and spaced inwardly from said skirt, (4) an inwardly extending, annular flange at the bottom edge of said inner wall, (5) an upwardly extending dispensing nozzle having an open lower end that is defined by the inner edge of said flange and which protrudes upwardly beyond said body rim, (b) a saucer-shaped lid having (1) a generally flat top, (2) a circular rim having a diameter no greater than the diameter of said body rim, (3) a nozzle cap on the under side of the top of said lid that is adapted to telescope over the upper end of said nozzle, (c) a flexible hinge web connecting said lid and said body and providing for movement of said lid both (1) angularly between a nozzle closing position in which said lid closely overlies said body with no portion of said lid extending beyond said body rim and an open position with said lid swung away from a nozzle obstructing location and (2) laterally relative to said body from said closing position in a direction transverse to the direction of such angular movement, and (d) co-operating catch means on the edges of said body rim and said lid rim which are engaged when said lid is in closing position and are at least partially disengageable upon such lateral movement of said lid for to a position in which a portion of said lid outwardly beyond said body rim.

11. A child-resistant dispensing closure according to claim 10 and co-operating means on the body and the lid for limiting the lateral movement of said lid for retaining the catch means in partial engagement when said lid is moved to project a portion of said lid outwardly beyond said body rim.

* * * * *